US011399592B2

(12) United States Patent
Xanthos

(10) Patent No.: US 11,399,592 B2
(45) **Date of Patent: *Aug. 2, 2022**

(54) FLEXIBLE SOLE FOR ARTICLE OF FOOTWEAR

(71) Applicant: NIKE, Inc., Beaverton, OR (US)

(72) Inventor: George Xanthos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 151 days.

This patent is subject to a terminal disclaimer.

(21) Appl. No.: 16/851,935

(22) Filed: Apr. 17, 2020

(65) Prior Publication Data

US 2020/0237049 A1 Jul. 30, 2020

Related U.S. Application Data

(63) Continuation of application No. 15/603,972, filed on May 24, 2017, now Pat. No. 10,638,812.

(51) Int. Cl.
*A43B 13/14* (2006.01)
*A43B 13/18* (2006.01)
(Continued)

(52) U.S. Cl.
CPC ..... *A43B 13/141* (2013.01); *A43B 1/0009* (2013.01); *A43B 13/04* (2013.01);
(Continued)

(58) Field of Classification Search
CPC ..... A43B 13/141; A43B 1/0009; A43B 13/04; A43B 13/125; A43B 13/127;
(Continued)

(56) References Cited

U.S. PATENT DOCUMENTS 2,162,912 A 6/1939 Craver
4,498,251 A * 2/1985 Shin ..... A43B 5/06 36/30 R (Continued)

FOREIGN PATENT DOCUMENTS

CN 102083335 A 6/2011
CN 103355830 A 10/2013

(Continued)

OTHER PUBLICATIONS

Office Action received for European Patent Application No. 18731296.2, dated Dec. 3, 2020, 6 pages.

(Continued)

*Primary Examiner* — Jameson D Collier
(74) *Attorney, Agent, or Firm* — Shook, Hardy & Bacon L.L.P.

(57) ABSTRACT

A sole structure for an article of footwear includes a midsole coupled to an outsole. The midsole includes a plurality of sipes on a first side and a plurality of sipes on a second side opposite the first side. The sipes partition portions of the midsole body into impact attenuation cells on the first and second sides of the midsole. The second side of the midsole further includes a plurality of grooves and a plurality of protruding members separated by the grooves. The protruding members extend from a midsole body towards the outsole when the midsole is coupled to the outsole, spacing the midsole body apart from the outsole.

17 Claims, 5 Drawing Sheets

(51) Int. Cl.

| | |
|---|---|
| ***A43B 13/12*** | (2006.01) |
| ***A43B 13/22*** | (2006.01) |
| ***A43B 1/00*** | (2006.01) |
| ***A43B 13/04*** | (2006.01) |

(52) U.S. Cl.
CPC ..... *A43B 13/125* (2013.01); *A43B 13/127* (2013.01); *A43B 13/181* (2013.01); *A43B 13/186* (2013.01); *A43B 13/188* (2013.01); *A43B 13/226* (2013.01)

(58) Field of Classification Search
CPC ... A43B 13/181; A43B 13/186; A43B 13/188; A43B 13/226; A43B 13/00; A43B 13/14; A43B 13/18; A43B 13/223
See application file for complete search history.

(56) References Cited

U.S. PATENT DOCUMENTS

| | | | | |
|---|---|---|---|---|
| 4,676,010 | A | 6/1987 | Cheskin | |
| 5,408,761 | A | 4/1995 | Gazzano | |
| 5,806,209 | A | 9/1998 | Crowley et al. | |
| 5,983,529 | A | 11/1999 | Sema | |
| 6,098,313 | A | 8/2000 | Skaja | |
| 6,115,945 | A | 9/2000 | Ellis, III | |
| 6,393,732 | B1 | 5/2002 | Kita | |
| 6,708,427 | B2 | 3/2004 | Sussmann et al. | |
| 7,100,307 | B2 | 9/2006 | Burke et al. | |
| 7,555,851 | B2 | 7/2009 | Hazenberg et al. | |
| 7,591,919 | B2 | 9/2009 | Schindler et al. | |
| 8,103,112 | B2 | 1/2012 | Horie et al. | |
| 8,186,079 | B2 | 5/2012 | Carboy et al. | |
| 8,291,618 | B2 | 10/2012 | Ellis | |
| 8,393,028 | B2 | 3/2013 | Namkook et al. | |
| 8,505,220 | B2 | 8/2013 | James et al. | |
| 8,555,525 | B2 | 10/2013 | Mahoney | |
| 8,656,613 | B2 | 2/2014 | Stockbridge et al. | |
| 8,707,587 | B2 | 4/2014 | Christensen et al. | |
| 10,638,812 | B2 * | 5/2020 | Xanthos | A43B 13/127 |
| 2003/0226280 | A1 * | 12/2003 | Paratore | A43B 13/223 36/4 |
| 2005/0252037 | A1 * | 11/2005 | Hofmann | A43B 1/0072 36/28 |
| 2006/0156579 | A1 | 7/2006 | Hoffer et al. | |
| 2007/0266598 | A1 | 11/2007 | Pawlus et al. | |
| 2008/0307679 | A1 | 12/2008 | Chiang et al. | |
| 2010/0223810 | A1 | 9/2010 | Lekhtman et al. | |
| 2010/0269271 | A1 | 10/2010 | Kim et al. | |
| 2013/0276333 | A1 | 10/2013 | Wawrousek et al. | |
| 2014/0150297 | A1 | 6/2014 | Holmes et al. | |
| 2014/0223776 | A1 | 8/2014 | Wardlaw et al. | |
| 2014/0259744 | A1 | 9/2014 | Cooper | |
| 2015/0101214 | A1 | 4/2015 | Gheorghian et al. | |
| 2015/0230548 | A1 | 8/2015 | Cross | |
| 2016/0037858 | A1 | 2/2016 | Foxen | |
| 2016/0051012 | A1 | 2/2016 | Avar et al. | |
| 2018/0338567 | A1 | 11/2018 | Xanthos | |
| 2019/0090583 | A1 * | 3/2019 | Sato | A43B 13/14 |

FOREIGN PATENT DOCUMENTS

| | | | |
|---|---|---|---|
| DE | 29722424 | U1 | 3/1998 |
| EP | 2238848 | A1 | 10/2010 |
| EP | 2554070 | A1 | 2/2013 |
| FR | 855201 | | 5/1940 |
| WO | 81/03112 | A1 | 11/1981 |
| WO | 2014/152367 | A1 | 9/2014 |

OTHER PUBLICATIONS

Intention to Grant received for European Patent Application No. 18731296.2, dated May 26, 2021, 4 pages.
Extended European Search Report received for European Patent Application No. 21204916.7, dated Mar. 10, 2022, 13 pages.

* cited by examiner

FLEXIBLE SOLE FOR ARTICLE OF FOOTWEAR

CROSS-REFERENCE TO RELATED APPLICATIONS

This application entitled "FLEXIBLE SOLE FOR ARTICLE OF FOOTWEAR" is a continuation of U.S. Nonprovisional application Ser. No. 15/603,972, entitled "FLEXIBLE SOLE FOR ARTICLE OF FOOTWEAR" and filed on May 24, 2017, which is incorporated by reference in its entirety.

BACKGROUND

Footwear articles often include sole structures that provide various functions. For instance, a sole structure generally protects a wearer's foot from environmental elements and from a ground surface. In addition, a sole structure may attenuate the impact or force caused by a ground surface or other footwear-contacting surfaces. Because sole structures often need to accommodate different types of movements and walking surfaces, flexibility within the sole structure is often desired.

BRIEF DESCRIPTION OF THE DRAWINGS

Subject matter is described in detail in this Specification with reference to the attached drawing figures, which are incorporated herein by reference, wherein.

DETAILED DESCRIPTION

Subject matter is described throughout this Specification in detail and with specificity in order to meet statutory requirements. But the aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This principle is contemplated by and is within the scope of the claims.

Figure 1:
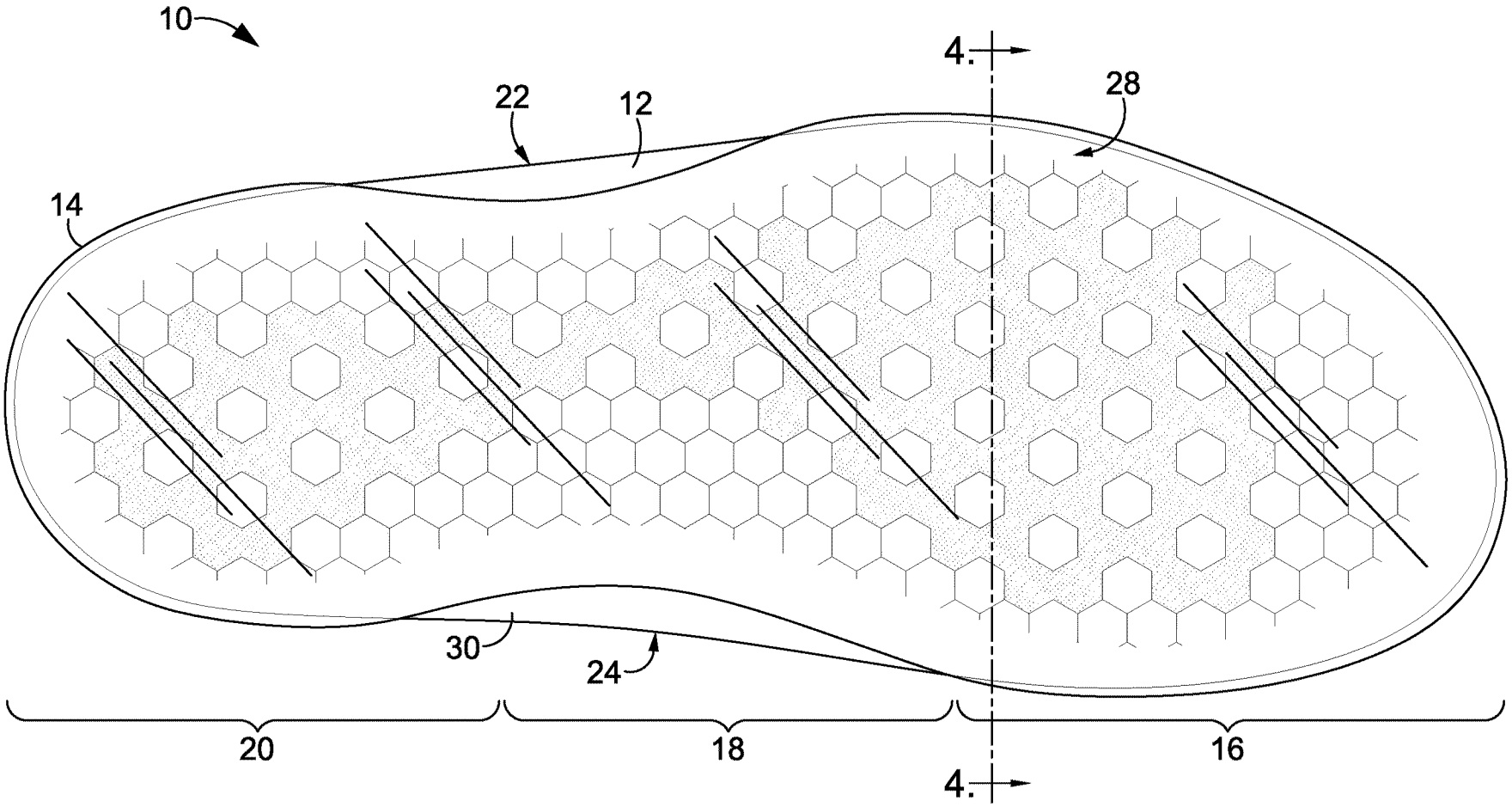
FIG. 1 depicts perspective view of a sole structure for an article of footwear in accordance with an aspect hereof.

FIG. 1 depicts a bottom of a sole structure 10 for an article of footwear. The sole structure 10 includes an outsole 14 that forms a ground-contacting surface and a midsole 12 attached to the outsole 14. The outsole 14 may be made of a relatively hard and durable material, such as a natural rubber, a plastic, or a synthetic material, such as polyurethane. The outsole 14 depicted in FIG. 1 is constructed from a transparent material to better illustrate the features of the midsole 12, but it is contemplated that the outsole may be non-transparent in other aspects. The midsole 12 may be formed from a material that provides cushioning and absorbs/attenuates impact force during normal wear and/or athletic training or performance. Examples of materials often used in midsoles are, for example, ethylene vinyl acetate (EVA), thermoplastic polyurethane (TPU), thermoplastic elastomer (e.g., polyether block amide), and the like. Generally, the sole structure 10 may be secured to an upper (not pictured). The sole structure 10 and an upper generally form a foot-receiving space that encloses at least part of a foot when the footwear is worn or donned. The sole structure 10 further supports the foot and may include multiple components.

The sole structure 10 may further have additional components not depicted, including additional cushioning components (e.g., springs, air bags, and the like), functional components (e.g., motion control elements to address pronation or supination), protective elements (e.g., resilient plates to prevent damage to the foot from hazards on the floor or ground), and the like. In addition, the sole structure 10 may include one or more insoles, sockliners, or other layers that are positioned between the foot-receiving space and the midsole 12. The sole structure 10 may also include various other elements such as a heel counter and a toe cap.

When describing various aspects of the sole structure 10, relative terms may be used to aid in understanding relative relationships. For instance, the sole structure 10 may be divided into three general regions: a forefoot region 16, a midfoot region 18, and a heel region 20. The sole structure 10 also includes a lateral side 22, a medial side 24, a first side 26, and a second side 28. The forefoot region 16 generally includes portions of the sole structure 10 corresponding with the toes and the joints connecting the metatarsals with the phalanges. The midfoot region 18 generally includes portions of sole structure 10 corresponding with the arch area of the foot, and the heel region 20 corresponds with rear portions of the foot, including the calcaneus bone. The lateral side 22 and the medial side 24 extend through each of regions 16, 18, and 20 and correspond with opposite sides of sole structure 10. More particularly, the lateral side 22 corresponds with an outside area of the foot (i.e., the surface that faces away from the other foot), and the medial side 24 corresponds with an inside area of the foot (i.e., the surface that faces toward the other foot). Further, the first side 26 (shown in FIG. 2) and the second side 28 also extend through each of the regions 16, 18, and 20. The first side 26 of the sole structure 10 generally corresponds with a superior portion that is oriented towards a person's foot when an article of footwear comprising the sole structure 10 is being worn, whereas the second side 28 generally corresponds with a bottom portion oriented away from the wearer's foot and towards the outsole 14 and/or the ground, floor, or other surface. The regions 16, 18, and 20 and the sides 22, 24, 26, and 28 are not intended to demarcate precise areas of the sole structure 10. Rather, regions 16, 18, and 20 and sides 22, 24, 26, and 28 are intended to represent general areas of the sole structure 10 to aid in understanding the various descriptions provided in this Specification. In addition, regions 16, 18, and 20 and sides 22, 24, 26, and 28 are provided for explanatory and illustrative purposes and are not meant to require a human being for interpretive purposes.

The illustrative figures depict, and the Specification describes, certain styles of articles of footwear, such as articles of footwear worn when engaging in athletic activities (e.g., basketball shoes, cross-training shoes, running shoes, and the like). But the subject matter described herein may be used in combination with other styles of articles of footwear, such as dress shoes, sandals, loafers, boots, and the like.

As mentioned, FIG. 1 depicts a sole structure 10 formed of an outsole 14 coupled to a midsole 12. Because soles protect the wearer's foot from the impact of contacting the ground or other surface and provide stability, soles can be somewhat rigid. At the same time protection and support is needed, flexibility within the sole is advantageous for various activities, including those that involve speed or agility. Sipes or grooves in one or more components of a sole provide increased flexibility by allowing the sole to expand. To impede rocks and other debris from become trapped in the sipes or grooves, an outsole may be coupled to an inferior surface of the midsole. This process is sometimes referred to as "skinning" the midsole, and skinning may include a variety of different constructions in which an additional layer is coupled to a midsole to provide added functionality (e.g., protection, support, rigidity, and the like). Skinning the midsole, however, may reduce the amount of flexibility otherwise afforded by the midsole alone. The sole structure 10 disclosed herein is designed to provide increased flexibility and maintain flexibility, including flexibility for dorsi-flexion and lateral stretch, when the midsole 12 is coupled to the outsole 14. The sole structure 10 provides this flexibility through a combination of sipes and grooves spacing apart protruding members on the midsole 12, with the grooves and protruding members forming voids when the midsole is coupled to the outsole 14.

Figure 2:
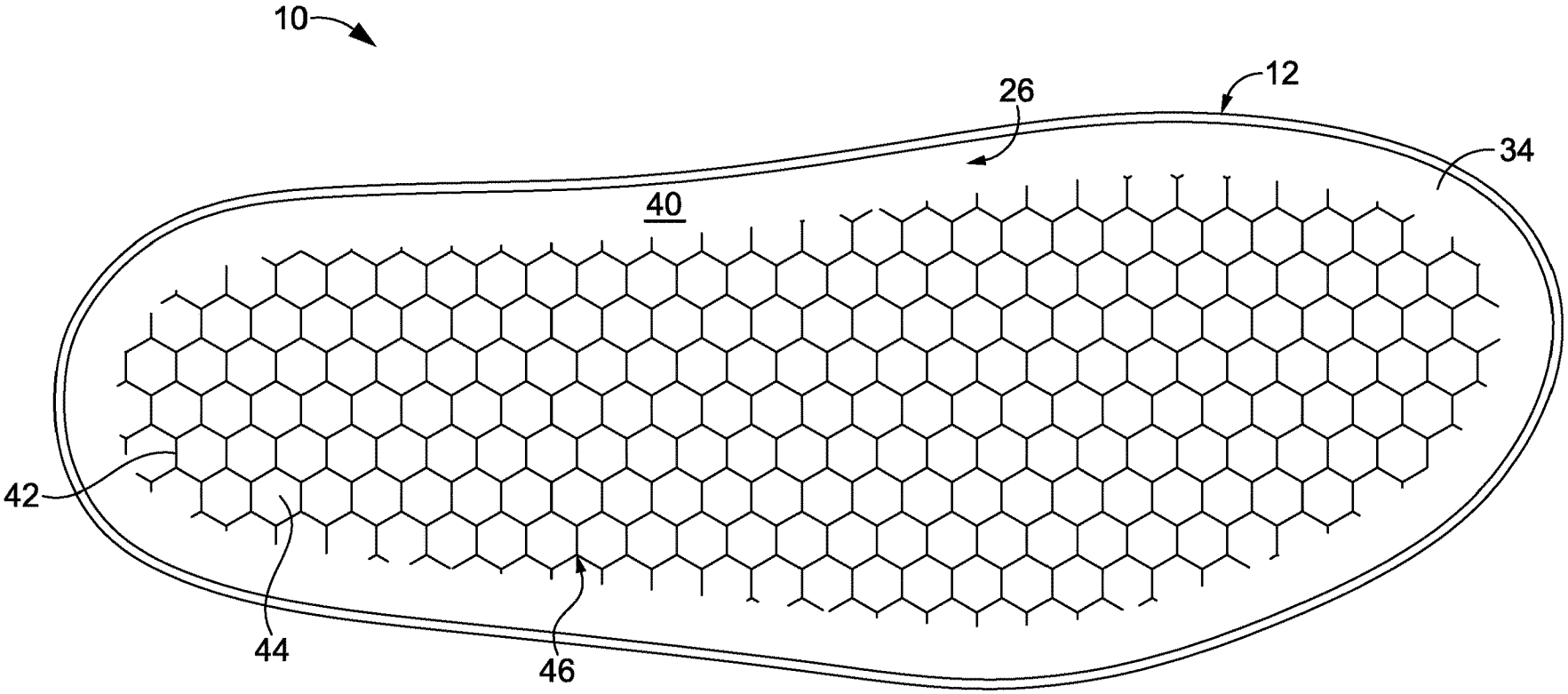
FIG. 2 depicts a top view of the sole structure of FIG. 1 in accordance with an aspect hereof.
Figure 3:
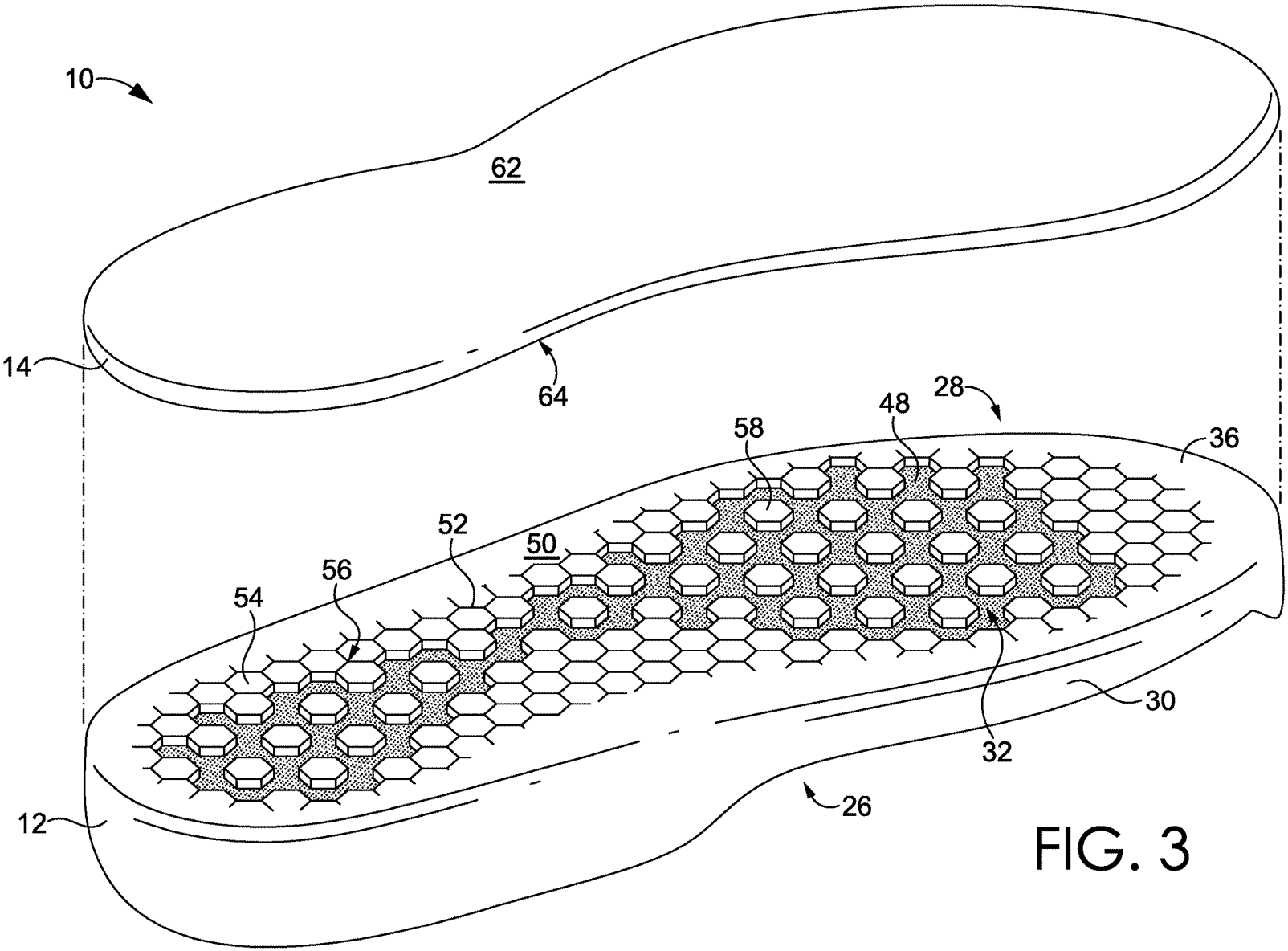
FIG. 3 depicts an exploded view of the sole structure of FIG. 1 in accordance with an aspect hereof.

Turning to FIGS. 1-3, the midsole 12 includes a first surface 40, which is the outermost surface on the first side 26 of the midsole 12, and a second surface 50, which is opposite the first surface 40 and is the outermost surface on the second side 28 of the midsole 12. When footwear having the midsole 12 is being worn in anatomical position, the second surface 50, which may also be referred to as the inferior surface, is oriented downwards towards the outsole and/or ground, floor, or other surface and the first surface 40, which may also be referred to as the superior surface, is oriented upwards towards the wearer's foot bed. Between the second surface 50 and the first surface 40 is a midsole body 30 that forms a middle portion of the midsole 12.

As illustrated in FIG. 2, the first side 26 of the midsole 12 may include a first plurality of sipes 42. The first plurality of sipes 42, also referred to herein as superior sipes, are linear slits incised, scored, formed or otherwise integrated into the first surface 40 of the midsole 12 and extend partially through the midsole body 30 towards the second side 28. Superior sipes 42 may extend longitudinally, laterally or diagonally across portions of the first surface 40. In some aspects, the first surface 40 includes a perimeter 34 such that the superior sipes 42 do not extend to the edges of the midsole 12. Additionally, superior sipes 42 intersect with one another to form a sipe pattern on the first surface 40. For example, superior sipes 42 form a hexagonal pattern comprising a plurality of hexagonal shapes. Each corner of the hexagonal shapes is adjacent a superior sipe intersection 46 comprising an intersection of three superior sipes 42. It is contemplated that the superior sipes 42 may form various patterns forming other shapes, such as triangles, squares, pentagons, and the like.

The hexagonal pattern represents a plurality of impact-attenuation cells 44. In this way, the superior sipes 42 partition the midsole 12 into the plurality of impact-attenuation cells 44. An impact-attenuation cell 44 refers to a portion of the midsole 12 having a prismatic polyhedral body. The base of the prismatic polyhedral body is a hexagonal-shaped base comprising the first surface 40 of the midsole 12. Each impact-attenuation cell 44 is attached to a substratum portion 32 (shown in in FIG. 3), which comprises a central region of the midsole body 30. Each impact-attenuation cell 44 is attached to a substratum portion 32 at an end of the prismatic polyhedral body opposite the hexagonal-shaped base. The impact-attenuation cells 44 are in a unitary construction with the midsole body 30 and may comprise of material providing cushioning and impact absorption, such as ethylene vinyl acetate (EVA), thermoplastic polyurethane (TPU), thermoplastic elastomer (e.g., polyether block amide), and the like. Accordingly, the impact-attenuation cells 44 provides areas of cushioning for absorbing impact forces, such as ground-impact forces.

At the same time, however, the impact-attenuation cells 44 are separated from each other on multiple sides by superior sipes 42, they can provide discrete areas of cushioning while allowing flexibility. Each superior sipe 42 defining an impact-attenuation cell 44 provides an area for expansion or flexion. With the hexagonal-shaped impact-attenuation cells 44, for example, each impact-attenuation cell 44 is defined by six superior sipes 42, and, therefore, there are six areas of expansion around each impact-attenuation cell 44. Because each area of expansion allows for flexibility, this patterns provides six directions of flexibility at each impact-attenuation cell 44.

Each superior sipe 42 may have a relatively short length compared to the width and length of the midsole 12. In some aspects, the length of superior sipes are within a range of about two millimeters to about ten millimeters. For example, the length of one or more superior sipes may be approximately eight millimeters. Generally, superior sipes 42 adjacent the perimeter 34 may comprise a shorter length than superior sipes 42 not adjacent the perimeter 34. Utilizing shorter sipe lengths relative to the length and width of the midsole 12 provides for a greater number of impact-attenuation cells 44 on the first side 26 of the midsole 12, which in turn provides more areas for flexion. With a greater number of impact-attenuation cells 44 and areas for flexion, the flexion is more localized to area in which flexion is needed without expanding nearby superior sipes 42. The ability to provide more localized flexion allows for a greater variety of movements within the midsole 12.

In some aspects, such as the one depicted in FIG. 2, superior sipes 42 extend continuously inside the perimeter 34 of the midsole 12 throughout the forefoot region 16, the midfoot region 18, and the heel region 20. It is also appreciated that the midsole 12 may comprise two or more areas of superior sipes 42 separated from one another by non-siped areas.

FIG. 3 depicts an exploded, perspective view of the second side 28 of the sole structure 10. The outsole 14 comprises a ground-contacting surface 62, which is the outermost surface on the second side 28 of the sole structure 10, and a midsole-facing surface 64, which is opposite the ground-contacting surface 62. When footwear having the sole structure 10 is worn in anatomical position, the ground-contacting surface 62 is oriented downwards towards the ground, floor, or other external surface, and the midsole-facing surface 64 is oriented upwards towards the second surface 50 of the midsole 12. Although the ground-contacting surface 62 of the outsole 14 is illustrated as having a smooth surface, it is contemplated that the outsole 14 may include functional or protective components, such as treads, cleats, spikes, siping, and the like.

As shown in FIG. 3, the second surface 50 of the midsole 12 is orientated towards the outsole 14 and comprises a second plurality of sipes 52, referred to herein as inferior sipes, similar to the superior sipes 42. Inferior sipes 52 may be linear slits incised, scored, formed or otherwise integrated into the second surface 50 of the midsole 12 and extend partially through the midsole body 30 towards the first side 26. Like the superior sipes 42, the inferior sipes 52 may extend longitudinally, laterally or diagonally across portions of the second surface 50 and intersect with one another to form a sipe pattern on the second surface 50, which may be similar to the pattern on the first surface 40. For example, in FIG. 3, the inferior sipes 52 intersect to form a plurality of hexagonal shapes. The inferior sipes 52 may also have a sipe length substantially the same as the sipe length of the superior sipes 42 such that the hexagonal shapes formed in the second surface 50 are substantially the same size as those formed on first surface 40. In alternative aspects, however, intersecting inferior sipes 52 may intersect in a different arrangement to form different shapes than the superior sipes or may be of a different length to form shapes of a different size. Additionally, the second surface 50 may include a perimeter 36 such that the inferior sipes 52 do not extend to the edges of the midsole 12.

In addition to the inferior sipes 52, the second side 28 of the midsole 12 includes a plurality of grooves 48 constructed into the second surface 50 of the midsole 12. The grooves 48 may be wider than the inferior sipes 52 and correspond with areas in which portions of the second surface 50 are omitted. Accordingly, in some aspects, the grooves 48 are constructed by removing portions of the second surface 50 and midsole body 30 via laser etching, carving, cutting, coring out, and the like. Additionally, the grooves 48 have a depth spanning the distance from the second surface 50 to the substratum portion 32 of the midsole body 30.

The grooves 48 may intersect one another to define and space apart protruding members 58 on the second side 28 of the midsole 12. A protruding member 58, as used herein, generally refers to a portion of the midsole 12 that extends outward from the midsole body 30 and is surrounded by grooves 48. When the midsole 12 is coupled to the outsole 14, the protruding members 58 extend towards the outsole 14. In exemplary aspects, the protruding members 58 have a unitary construction with the midsole body 30 and comprise the same material forming the midsole body 30. In it also contemplated, however, that the protruding members 58 may be constructed from a material different than the midsole body 30 and that the protruding members 58 may be constructed separately from and later secured to the midsole body 30.

The second side 28 of the midsole may further comprise a plurality of impact-attenuation cells 54 similar to the impact-attenuation cells 44 on the first side 26 and that are formed by inferior sipes 52 or a combination of inferior sipes 52 and grooves 48. The impact-attenuation cells 54 on the second side 28 are unlike the protruding members 58 in that the impact-attenuation cells 54 are defined by at least one inferior sipe 52. The protruding members 58 and impact-attenuation cells 54 on the second side 28 may both function similarly to the impact-attenuation cells 44 on the first side 26 in that they provide cushioning for impact forces. When the midsole 12 is coupled to the outsole, the protruding members 58 may additionally provide support to the grooved areas of the midsole 12 and keep the midsole body 30 spaced apart from the outsole 14.

The shape of the protruding members 58 is determined by the groove pattern, while the shape of the impact-attenuation cells 54 is determined by the sipe pattern and the groove pattern. In the aspect illustrated in FIG. 3, the inferior sipes 52 and grooves 48 both create a hexagonal pattern to define impact-attenuation cells 54 and protruding members 58 having a prismatic polyhedral body. Accordingly, the base of the prismatic polyhedral bodies are hexagonal shaped and comprise portions of the second surface 50 of the midsole 12. Each impact-attenuation cell 54 and protruding member 58 may be attached to the substratum portion 32 of the midsole body 30 at an end opposite the hexagonal base. In this way, the substratum portion 32 of the midsole body 30 acts as an connecting member between the impact attenuation cells 44 on the first side 26 and the impact attenuation cells 54 and protruding members 58 on the second side 28. Further, in FIG. 3, the protruding members 58 are similar in size and shape to the impact-attenuation cells 54; however, in other aspects, the protruding members 58 may comprise other configurations. For instance, the protruding members 58 may have a size and shape equal to two or more impact-attenuation cells grouped together.

As discussed above with respect to the superior sipes 42, the inferior sipes 52 provide flexibility around the impact-attenuation cells 54. The grooves 48 further provide flexibility around the protruding members 58 and partially around at least a portion of the impact-attenuation cells 54. Because the grooves 48 are wider than the inferior sipes 52, the grooves 48 provide a greater degree of flexion between neighboring protruding members 58 and/or impact-attenuation cells 54. Additionally, when coupled to the outsole 14, the portions of the midsole 12 corresponding with grooves 48 are spaced apart from the outsole 14 and, as such, are not directly attached to the outsole 14. As previously mentioned, when a siped midsole is coupled to an outsole, the degree of flexibility afforded by sipes alone is limited by the degree of flexibility in the outsole. However, the portions of the midsole 12 unattached from the outsole 14 along the grooves 48 are able to stretch more freely, which minimizes the loss in flexibility when the midsole 12 is coupled to the outsole 14. Specifically, the grooves 48 increase flexibility along the second side 28 of the midsole 12, which allows for greater dorsi-flexion and helps to recapture an accordion effect between the second side 28 and the first side 26 to provide for greater lateral flexibility. Additionally, because the grooves 48 are omitted portions of the midsole body 30, the overall weight of the midsole 12 is decreased.

Locations of grooves 48 and protruding members 58 on the midsole 12 may vary depending on the cushioning needs. In aspects illustrated, the grooves 48 and protruding members 58 are surrounded by the siped portion of the second surface 50 of the midsole 12. The protruding members 58 may be arranged in rows spanning a portion of the width of the midsole 12, and the protruding members 58 may be laterally offset from protruding members 58 in an adjacent row. In portions of the forefoot region 16, area with grooves 48 and protruding members 58 spans approximately three-quarters of the width of the midsole 12. In the midfoot region 18 that supports the arch of a wearer's foot, the grooves 48 and protruding members 58 span across a short portion of the midsole 12's width. In the aspect shown, there is a single, continuous grooved area such that the intersecting grooves 48 are continuous along the midsole 12. In alternative aspects, there may be multiple grooved areas that are separated by the second surface 50 of the midsole. For example, there may be a first grooved area in the forefoot region 16, a second grooved area in the heel region 20, and a non-grooved area, which may comprise superior sipes 42 or may have a substantially smooth surface texture, in midfoot region 18 separating to two grooved areas. In some aspects, such as the aspect illustrated in FIG. 3, the recessed areas forming the grooves 48 comprise a larger percentage of the width of the midsole 12 in areas of the midsole 12 that are most likely to receive ground-impact forces. As such, in FIG. 3, the grooved areas comprise a larger percentage of the width of the midsole 12 in the forefoot region 16 and heel region 20 compared to the midfoot region 18. It is contemplated, however, that other aspects of the midsole 12 may comprise other configurations of the grooves 48 within regions 16, 18, and 20.

Figure 4:
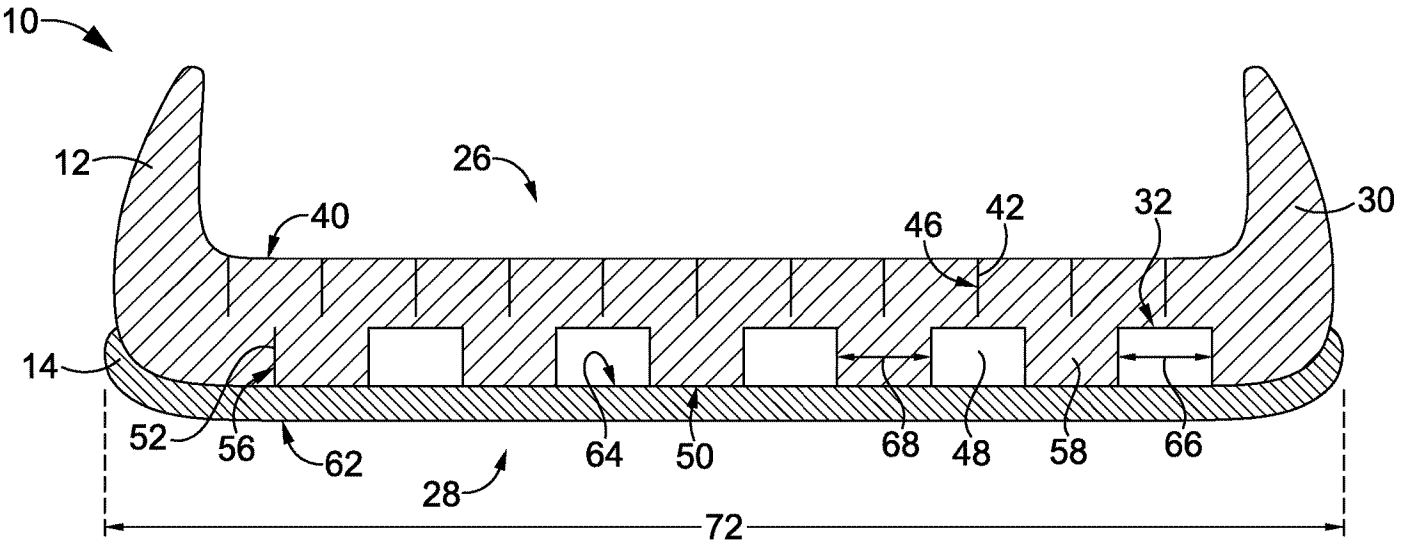
FIG. 4 depicts a cross-sectional view of the sole structure of FIG. 1, taken at reference line 4 in FIG. 1 in accordance with an aspect hereof.

Turning to FIG. 4, a cross-sectional view of sole structure 10 taken at reference line 4 in FIG. 1 is provided. This cross-sectional view illustrates the spatial relationships between the superior sipes 42, inferior sipes 52, grooves 48, and protruding members 58. In exemplary aspects, the inferior sipes 52 are offset from the superior sipes 42. Consequently, superior sipe intersections 46 are offset from inferior sipe intersections 56. The superior sipes 42 and inferior sipes 52 visible in FIG. 4 correspond with locations of superior sipe intersections 46 and inferior sipe intersections 56, respectively. The sipe intersections 46 and 56, as represented by sipes 42 and 52, are offset from one another in a lateral direction in FIG. 4, and the sipe intersections 46 and 56 may also be longitudinally offset from one another. Each inferior sipe intersection 56 may be vertically aligned with a central region of an impact-attenuation cell 44 on the first side 26, and each superior sipe intersection 46 may be vertically aligned with either a central region of an impact-attenuation cell 54 or a central region of a groove 48 on the second side 28. Offsetting the sipe patterns and, therefore, the sipe intersections 46 and 56 creates an accordion effect that allows for expansion at the superior sipes and inferior sipes 42 and 52, respectively, and grooves 48 while maintaining structural integrity of the midsole 12. As previously mentioned, the grooves 48 minimize the reduction of this accordion effect when the midsole 12 is coupled to the outsole 14.

In aspects, the grooves 48 comprise a groove width 66 spanning a distance between a protruding member 58 and a neighboring protruding member 58 or impact-attenuation cell 54 on the second side 28. In some aspects, the groove width 66 is within a range of approximately eight millimeters to fifteen millimeters. For example, the groove width 66 may be approximately twelve millimeters. In relation to an overall midsole width 72 from the lateral side 22 to the medial side 24 of the midsole, the ratio of the groove width 66 to the midsole width 72 is in a range of about 1 to 5 to about 1 to 12. Additionally, the width 68 of a protruding member 58 may be substantially equal to the groove width 66 such that the protruding member width 68 is also within a range of approximately eight millimeters to fifteen millimeters.

Generally, the width of a sipe, whether an inferior sipe 52 or superior sipe 42, is substantially smaller than the groove width 66. For example, in some aspects the width of an inferior sipe 52 or superior sipe 42 is within a range of approximately half a millimeter to 2 millimeters. Because the sipe width is smaller than the groove width 66, there may be a greater number of superior sipes 42 on the first side 26 of the midsole 12 than the number of grooves 48 on the second side 28 of the midsole 12. For example, in some aspects, the ratio of sipes to grooves in a cross-sectional plane extending from the medial side to the lateral side is at least two to one.

Additionally, the depth of the groove may be equal to the distance between the second surface 50 and the substratum portion 32 of the midsole body 30. Further, the protruding members 58 form portions of the second surface 50 and extend from the substratum portion 32 and, therefore, the protruding height of a protruding member 58 may be equal to the groove depth.

As previously mentioned, the grooves 48 correspond with omitted portions of the second surface 50. Along the cross-reference plane extending from the lateral side to the medial side shown in FIG. 4, approximately 40 percent of the second surface 50 is omitted, forming five grooves. The percentage of the second surface 50 omitted to form the grooves 48 may vary based on the area in which the lateral-to-medial cross-sectional reference plane is taken and generally will be between approximately 20 percent and 50 percent.

Figure 6:
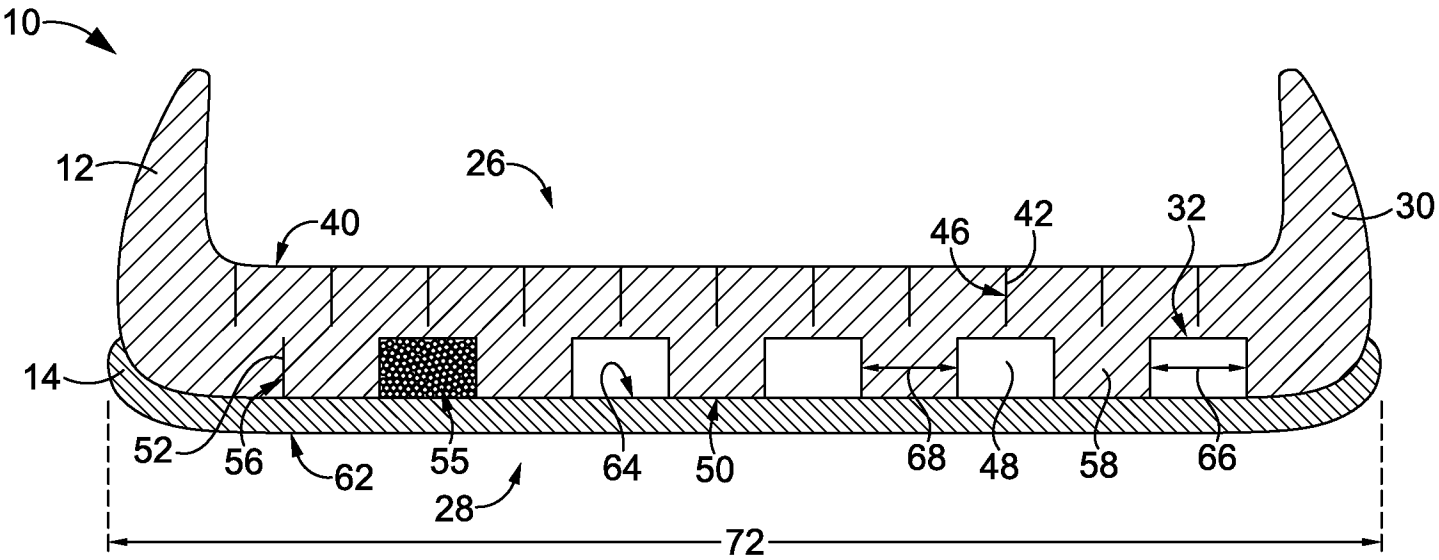
FIG. 6 depicts the cross-sectional view of the sole structure of FIG. 4 in accordance with an additional aspect hereof.

When the midsole 12 is coupled to the outsole 14, as shown in FIG. 4, the grooves 48 form voids between the substratum portion 32 and the outsole 14. In some aspects, these voids contain a cushioning element to provide secondary cushioning in addition to the cushioning provided by the protruding members 58 and impact-attenuation cells 44 and 54. The cushioning element may include ambient air, loose cushioning materials, or a combination of both. FIG. 6 depicts an aspect of the disclosure in which the voids between the substratum portion 32 and the outsole 14 contains loose cushioning materials 55. For clarity, only one of the voids is depicted as heaving the loose cushioning materials 55, but it is understood that other voids may include the loose cushioning materials 55.

Figure 5:
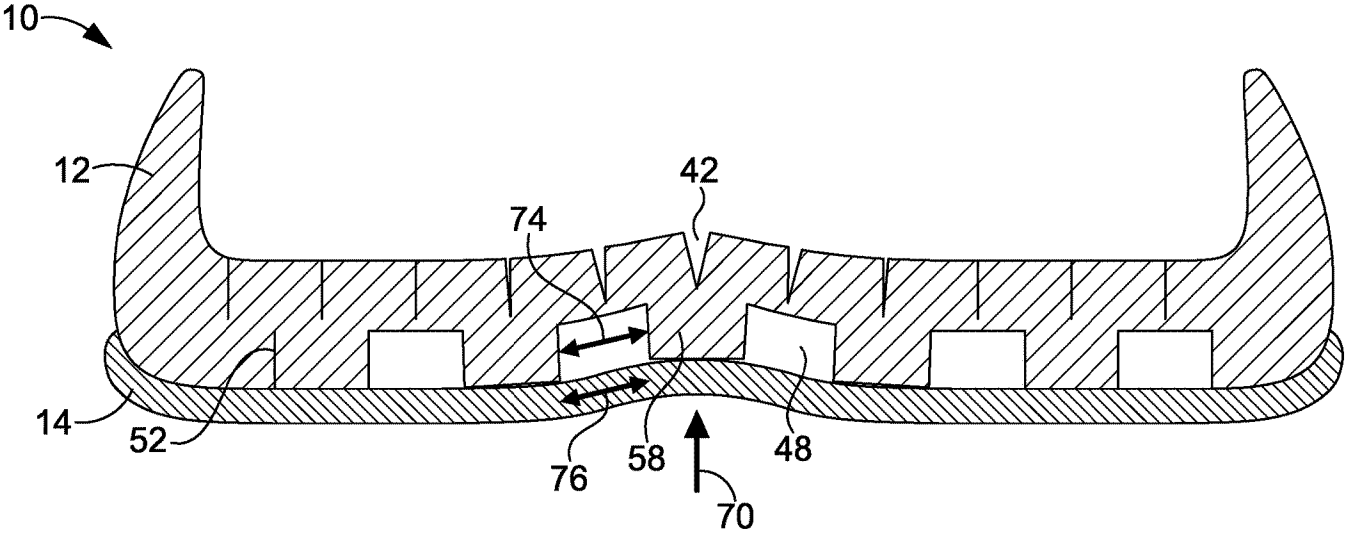
FIG. 5 depicts the cross-sectional view of the sole structure of FIG. 4 affected by a ground-impact force in accordance with an aspect hereof.

In addition to providing increased flexibility and allowing for a lighter-weight midsole 12, the grooves 48 also allow for a pistoning action, which is depicted in FIG. 5. When a portion of the sole structure 10 corresponding to a protruding member 58 contacts a raised surface area, such as when a wearer steps on an uneven ground surface or a pebble, an upward force, represented by arrow 70, is applied to the protruding member 58. The grooves 48 allow the protruding member 58 to move vertically in response to the force, while one or more superior sipes 42 flexes open. This vertical movement, or pistoning action, provides proprioception and increases the wearer's feel of the ground. Proprioception allows for a more natural gait and increases the wearer's understanding of the ground environment. FIG. 5 also depicts the increased flexibility of the midsole 12 and outsole 14 due to the arrangement of the protruding members 58 and grooves 48. For instance, the grooves 48 may flex open, as shown by flex arrow 74, to provide increased flexibility of the midsole 12. Additionally, portions of the outsole 14 unattached to the midsole 12 (i.e., portions corresponding to the grooves 48) also experience increased flexibility, as shown by flex arrow 76.

Accordingly, in one aspect of the disclosure, a midsole for an article of footwear comprises a midsole body having a first side, such as first side 26 discussed herein, and a second side, such as second side 28, a medial side and a lateral side. The first side and the second side generally face away from one another. The midsole also comprises a plurality of sipes incised into the first side and extending at least partially through the midsole body. The midsole further comprises a plurality of grooves constructed into an outermost surface of the second side such that a portion of the outermost surface is omitted at positions corresponding with the plurality of grooves. A cross-sectional reference plane of the midsole extends from the medial side to the lateral side and be generally perpendicular with the first side and the second side. In the cross-sectional reference plane, the portion of the outermost surface that is omitted comprises a percentage of the outermost surface in a range of about 20 percent to about 50 percent.

Another aspect herein comprises a sole assembly for an article of footwear. The sole assembling comprises a midsole coupled to an outsole. The midsole comprises a midsole body having a first side and a second side, which generally face away from one another, and a medial side and a lateral side. The first side faces away from the outsole and the second side faces towards the outsole. The midsole also comprises a plurality of sipes incised into the first side and extending at least partially through the midsole body and a plurality of grooves constructed into an outsole-facing surface of the second side. Additionally, the midsole includes a plurality of protruding members that extend outward from the second side and towards the outsole, the plurality of grooves spacing the plurality of protruding members apart from one another. The outsole is affixed directly to the protruding members, which space the outsole apart from the midsole body.

In yet another aspect, a midsole for an article of footwear comprises a midsole body having a first side and a second side that generally face away from one another and a medial side and a lateral side. The midsole also comprises a plurality of sipes incised into the first side and extending at least partially through the midsole body. The midsole further comprises a plurality of protruding members extending outward from the second side of the midsole body. The plurality of protruding members are spaced apart by a plurality of grooves constructed into an outermost surface of the second side. A cross-sectional reference plane of the midsole extends from the medial side to the lateral side and is generally perpendicular with the first side and the second side. In the cross-sectional reference plane, the ratio of sipes on the first side and grooves on the second side is at least two to one.

From the foregoing, it will be seen that aspects of this disclosure are well adapted to attain all the ends and objects hereinabove set forth together with other advantages that are obvious and are inherent to the structure. It will be understood that certain features and subcombinations are of utility and may be employed without reference to other features and subcombinations. This principle is contemplated by and is within the scope of the claims. Because many possible configurations and alternatives may be made of aspects herein without departing from the scope of this disclosure, it is to be understood that all matter herein set forth or shown in the accompanying drawings is to be interpreted as illustrative and not in a limiting sense.

What is claimed is:

1. A midsole for an article of footwear, the midsole comprising:

a midsole body having a first side, a second side that faces away from the first side, a medial side, and a lateral side; and a first plurality of sipes incised into the first side and extending at least partially through the midsole body, wherein the first plurality of sipes on the first side intersect with one another to partition a first plurality of impact-attenuation cells on the first side, wherein each impact-attenuation cell within the first plurality of impact-attenuation cells includes a prismatic polyhedral body having a hexagonal-shaped base that comprises an outermost surface of the first side, and wherein each corner of each hexagonal-shaped base within the first plurality of impact-attenuation cells is formed at an intersection of three sipes within the first plurality of sipes; and a plurality of grooves constructed into an outermost surface of the second side, such that a portion of the second side's outermost surface is omitted at positions corresponding with the plurality of grooves, each groove having a groove width, and each sipe having a sipe width, the groove width being greater than the sipe width when the midsole is in a relaxed state.

2. The midsole of claim 1, wherein the groove width is a range of eight millimeters to fifteen millimeters.

3. The midsole of claim 1, wherein a cross-sectional reference plane extends from the medial side to the lateral side and perpendicular with at least one of the first side and the second side, and wherein, in the cross-sectional reference plane, the portion of the second side's outermost surface that is omitted comprises a percentage of the second side's outermost surface in a range of 20 percent to 50 percent.

4. The midsole of claim 1 further comprising a second plurality of sipes incised into the second side and extending at least partially through the midsole body, the second plurality of sipes intersecting with one another to partition a second plurality of impact-attenuation cells on the second side.

5. The midsole of claim 4, wherein each impact-attenuation cell within the second plurality of impact attenuation cells on the second side includes a prismatic polyhedral body having a hexagonal-shaped base that comprises another portion of the outermost surface of the second side, wherein each corner of each hexagonal-shaped base of at least a first portion of impact-attenuation cells within the second plurality of impact-attenuation cells is formed at an intersection of three sipes within the second plurality of sipes.

6. The midsole of claim 5, wherein a first portion of the first plurality of impact-attenuation cells on the first side each has a central region that is vertically aligned with the intersection of three sipes within the second plurality of sipes on the second side, and wherein the first portion of the second plurality of impact-attenuation cells on the second side each has a central region that is vertically aligned with the intersection of three sipes within the first plurality of sipes on the first side.

7. A midsole for an article of footwear, the midsole comprising:

a midsole body having a first side, a second side that faces away from the first side, a medial side, and a lateral side;

a first plurality of sipes incised into the first side and extending at least partially through the midsole body, the first plurality of sipes on the first side intersecting with one another to partition a first plurality of impact-attenuation cells on the first side, wherein each impact-attenuation cell within the first plurality of impact-attenuation cells includes a prismatic polyhedral body having a hexagonal-shaped base that comprises an outermost surface of the first side, and wherein each corner of each hexagonal-shaped base within the first plurality of impact-attenuation cells is formed at an intersection of three sipes within the first plurality of sipes; and a plurality of grooves constructed into an outermost surface of the second side, each groove having a groove width and each sipe within the first plurality of sipes having a sipe width, the groove width being greater than the sipe width when the midsole is in a relaxed state, wherein a cross-sectional reference plane extends from the medial side to the lateral side and perpendicular with at least one of the first side and the second side, and wherein, in the cross-sectional reference plane, a ratio of sipes on the first side to grooves on the second side is at least two to one.

8. The midsole of claim 7, wherein the midsole body includes a midsole width extending from the medial side to the lateral side at a position aligned with the cross-sectional reference plane, and wherein a ratio of the groove width to the midsole width is in a range of 1:5 to 1:12.

9. The midsole of claim 7, further comprising:

a second plurality of sipes incised into the second side and extending at least partially through the midsole body, the second plurality of sipes on the second side intersecting with one another to partition a second plurality of impact-attenuation cells on the second side, wherein each impact-attenuation cell within the second plurality of impact-attenuation cells includes a prismatic polyhedral body having a hexagonal-shaped base that comprises a portion of the outermost surface of the second side, and wherein each corner of each hexagonal-shaped base of at least a first portion of impact-attenuation cells within the second plurality of impact-attenuation cells is formed at an intersection of three sipes within the second plurality of sipes, wherein a first portion of the first plurality of impact-attenuation cells on the first side each has a central region that is vertically aligned with the intersection of sipes within the second plurality of sipes on the second side, and wherein a second portion of the first plurality of impact-attenuation cells on the first side each has a central region that is vertically aligned with a groove within the plurality of grooves on the second side.

10. The midsole of claim 9, wherein at least some corners of the hexagonal-shaped base of a second portion of impact-attenuation cells within the second plurality of impact-attenuation cells are formed at an intersection of grooves.

11. The midsole of claim 9, wherein the second plurality of sipes are incised into a first region of the midsole body and the plurality of grooves are incised into a second region of the midsole body, and wherein the first region surrounds the second region on the second side of the midsole body.

12. A sole assembly for an article of footwear, the sole assembly comprising:

a midsole coupled to an outsole;

the midsole comprising:

a midsole body having a first side, a second side that faces away from the first side and is coupled to the outsole, a medial side, and a lateral side; and a first plurality of sipes incised into the first side and extending at least partially through the midsole body, wherein the first plurality of sipes on the first side intersect with one another to partition a first plurality of impact-attenuation cells on the first side, wherein each impact-attenuation cell within the first plurality of impact-attenuation cells includes a prismatic polyhedral body having a hexagonal-shaped base that comprises an outermost surface of the first side, and wherein each corner of each hexagonal-shaped base within the first plurality of impact-attenuation cells is formed at an intersection of three sipes within the first plurality of sipes, and a plurality of grooves constructed into an outermost surface of the second side, such that a portion of the second side's outermost surface is omitted at positions corresponding with the plurality of grooves, each groove having a groove width, and each sipe having a sipe width, the groove width being greater than the sipe width when the midsole is in a relaxed state.

13. The sole assembly of cam 12, wherein the midsole body further comprises:

a plurality of protruding members that extend outward from the second side and towards the outsole, wherein the outsole is affixed directly to the plurality of protruding members, which space the outsole apart from a substratum portion of the midsole body.

14. The sole assembly of claim 13, wherein the plurality of protruding members define one or more impact-attenuation voids between the outsole and the substratum portion of the midsole body, the substratum portion of the midsole body being positioned between an end of the first plurality of sipes incised into the first side and an end of the grooves constructed into the second side, the one or more impact-attenuation voids including ambient aft, loose cushioning materials, or any combination thereof.

15. The sole assembly of claim 13, wherein a cross-sectional reference plane extends from the medial side to the lateral side and is perpendicular with at least one of the first side and the second side, and wherein, in the cross-sectional reference plane, a ratio of all sipes within the first plurality of sipes on the first side to all grooves within the plurality of grooves on the second side is at least two to one.

16. The sole assembly of claim 12, wherein the midsole further comprises a second plurality of sipes incised into the second side and extending at least partially through the midsole body, the second plurality of sipes intersecting with one another to partition a second plurality of impact-attenuation cells on the second side.

17. The sole assembly of claim 16, wherein each impact-attenuation cell within the second plurality of impact attenuation cells on the second side includes a prismatic polyhedral body having a hexagonal-shaped base that comprises another portion of the outermost surface of the second side, wherein each corner of each hexagonal-shaped base of at least a first portion of impact-attenuation cells within the second plurality of impact-attenuation cells is formed at an intersection of three sipes within the second plurality of sipes.

* * * * *